US007118148B1

(12) United States Patent
Davis

(10) Patent No.: US 7,118,148 B1
(45) Date of Patent: Oct. 10, 2006

(54) LOAD CLAMPING PLATE

(76) Inventor: Steve Davis, 15823 Eagles Nest Dr., Fountain Hills, AZ (US) 85268

( * ) Notice: Subject to any disclaimer, the term of this patent is extended or adjusted under 35 U.S.C. 154(b) by 0 days.

(21) Appl. No.: 10/826,224

(22) Filed: Apr. 16, 2004

(51) Int. Cl.
*B66F 9/18* (2006.01)

(52) U.S. Cl. ..... 294/119.1; 294/902; 414/621

(58) Field of Classification Search ..... 294/119.1, 294/902, 88; 414/621, 607, 653, 785, 741, 414/618; 269/271, 273, 274, 279, 285
See application file for complete search history.

(56) References Cited

U.S. PATENT DOCUMENTS

| | | | | |
|---|---|---|---|---|
| 1,836,576 A | | 12/1931 | Chalmers | |
| RE23,694 E | * | 8/1953 | Ehmann | 414/621 |
| 2,674,387 A | | 4/1954 | Ehmann | |
| 2,681,162 A | | 6/1954 | Ehmann | |
| 2,890,807 A | | 6/1959 | Parcell | |
| 3,145,866 A | * | 8/1964 | Farmer et al. | 414/621 |
| 3,370,880 A | | 2/1968 | Carliss | |
| 3,400,965 A | * | 9/1968 | Olson | 294/119.1 |
| 3,433,376 A | * | 3/1969 | Jordan | 414/621 |
| 3,643,827 A | * | 2/1972 | Link | 414/621 |
| 4,175,903 A | * | 11/1979 | Carson | 414/408 |
| 4,642,020 A | | 2/1987 | Sinclair | |
| 5,033,933 A | | 7/1991 | Sinclair | |
| 5,575,608 A | | 11/1996 | Yau | |

* cited by examiner

*Primary Examiner*—Eileen D. Lillis
*Assistant Examiner*—Esther Onyinyechi Okezie
(74) *Attorney, Agent, or Firm*—LaValle D. Ptak

(57) ABSTRACT

A clamping plate assembly for movement laterally into and out of engagement with a load includes a main plate member which has front, rear, upper and lower edges. Along the lower edge of the main plate member, an auxiliary plate overlies a portion extending from the lower edge a predetermined distance toward the upper edge thereof, and is removably attached to the main plate member. A yieldable friction material then is over substantially the major portion of the auxiliary plate and the portion of the main plate member not covered by the auxiliary plate.

29 Claims, 4 Drawing Sheets

LOAD CLAMPING PLATE

BACKGROUND

This invention is in the field of industrial lift trucks which employ oppositely disposed load-clamping plates actuated toward and away from each other to clamp a load therebetween for lifting and transporting the load. When the load is transported to the location desired, the load clamping plates are moved away from one another to release the load.

DETAILED DESCRIPTION

Reference now should be made to the drawings, in which the same reference numbers designate the same or similar components throughout-the different figures. As illustrated generally in FIG. 1, an embodiment of the invention is shown as used in conjunction with an industrial lift truck.

Figure 1:
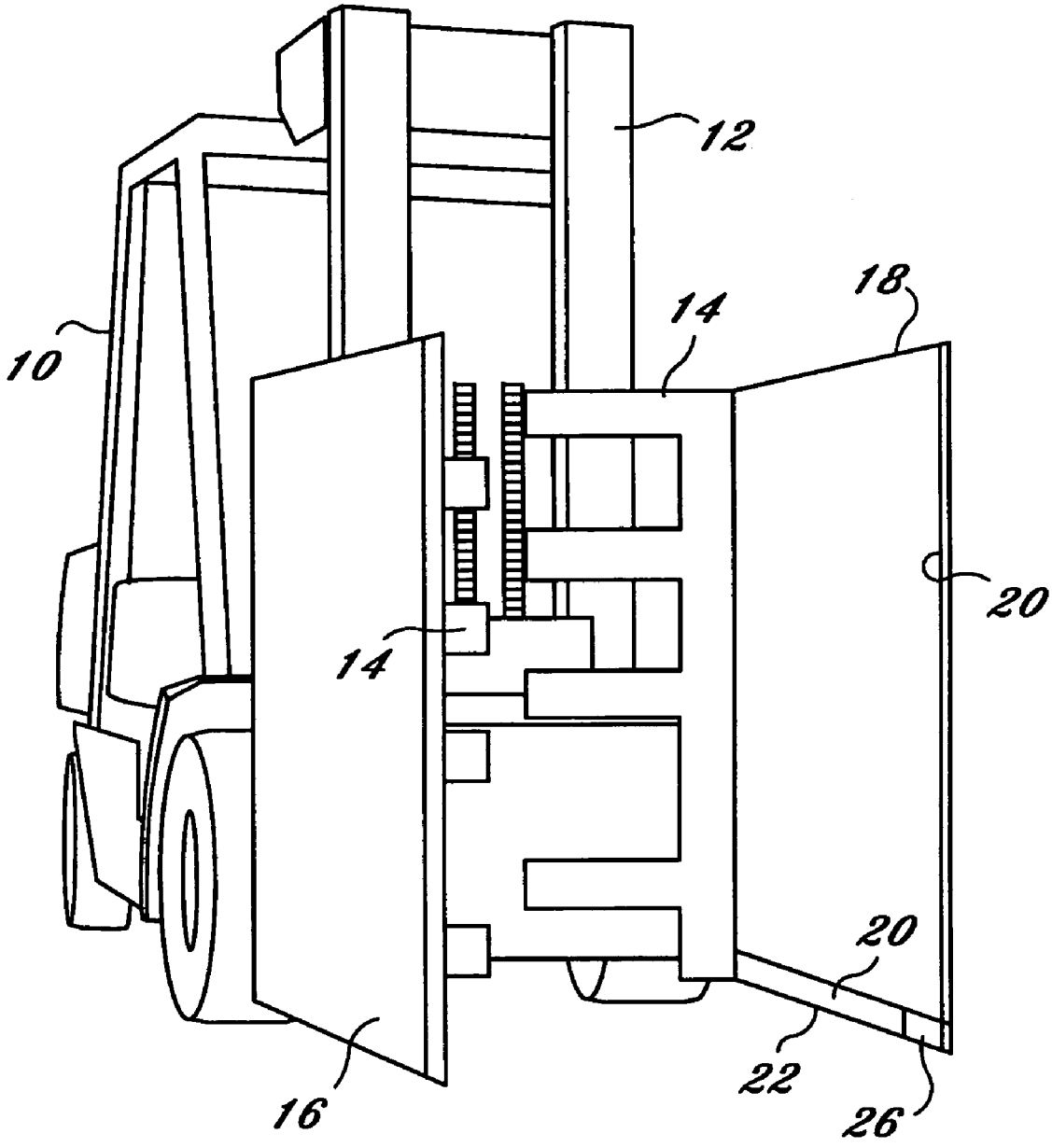
FIG. 1 is a front perspective view illustrating an embodiment of the invention as used on an industrial lift truck.
Figure 2:
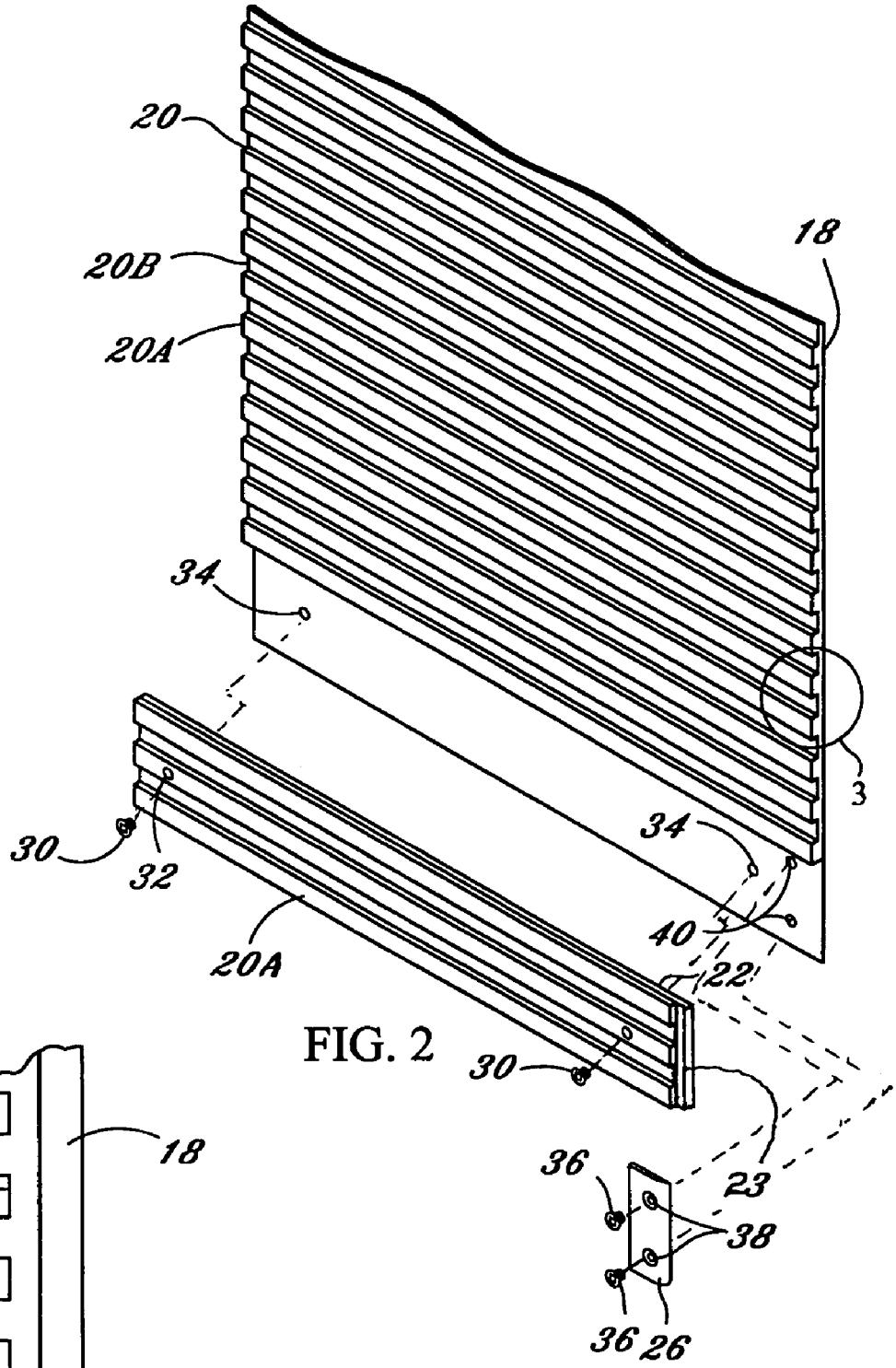
FIG. 2 is a partially exploded perspective view of the embodiment shown in FIG. 1.
Figure 3:
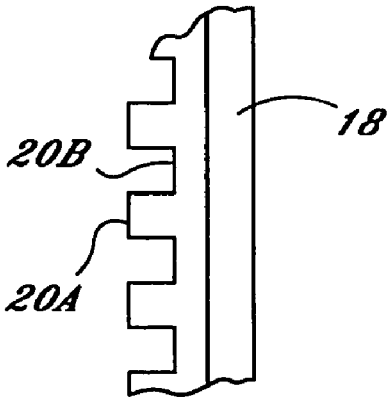
FIG. 3 is a detailed end view of the portion encircled as 3 in FIG. 2.
Figure 4:
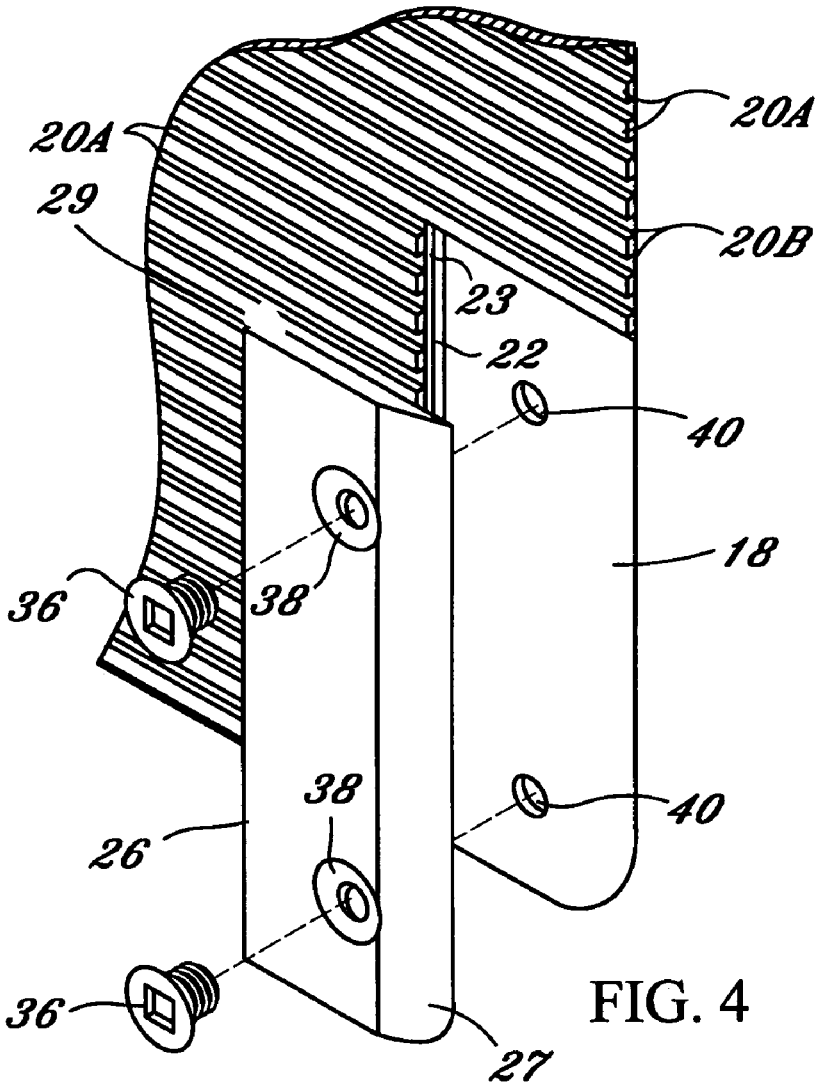
FIG. 4 is an exploded view of a portion of the embodiment of FIGS. 1 and 2, illustrating details thereof.

The lift truck 10 shown in FIG. 1 is designed to move a pair of oppositely disposed load clamping plates, including main plates 16 and 18, laterally toward and away from one another on mechanism 14, generally illustrated in FIG. 1, and vertically on additional mechanism 12, as shown in FIG. 1. The details of operating the assembly shown in FIG. 1 to effect the movement of the mechanisms 12 and 14 are not provided here, since those mechanisms are well known and are widely used in conjunction with industrial lift truck machines. In addition, the plates 16 and 18, employed with the lift truck 10 shown in FIG. 1, are of the size typically used with such industrial lift trucks, generally on the order of 4' by 4', or 4' by 3'. Some specialized applications may be significantly smaller or larger.

In operation, the plates 16 and 18 are moved adjacent the opposite sides of a stack of cartons or similar load (not shown), and then are moved toward one another to squeeze the stack of cartons to thereby allow the carton stack to be lifted by the mechanism 12. The carton stack then may be transported to a desired location. The mechanism 12 then is operated to either raise or lower the stack of cartons to a desired position. Finally, the plates 16 and 18 are moved away from one another laterally to allow the stack of cartons to be placed in a warehouse or truck, or other desired location.

In the embodiment shown in FIGS. 1 through 8, the facing surfaces of the main plate members 16 and 18 have yieldable friction material 20 bonded or attached to them. This material 20 may be rubber or rubber-like material having raised portions 20A separated by parallel grooves 20B extending from front to back, as illustrated most clearly in FIG. 4.

Rubber facings or other frictional rubber-like materials have been used to coat the facing surfaces of main plate members, such as the members 16 and 18 in the past. Typically, however, these surfaces undergo significant wear of the rubber coating along the lower front edge, and extending a substantial distance upward toward the upper edge of the main plates. If a significant exposure of the surface of the coated plate (which typically is made of aluminum) occurs, the slippage of a load which is squeezed between the plates frequently takes place. This is dangerous, and in the past the entire clamping pad assembly (including the large aluminum plates and the rubber coated surfaces) were replaced. Prior to replacement, it has been the practice in some environments to turn the clamping plates upside down; so that the upper edge now becomes the lower edge; and vice versa. When the significant wear once again occurs on the lower edge, the plates then typically have been discarded and replaced with new ones.

In the embodiment shown in FIGS. 1 through 8, the assembly described in the previous paragraph has been modified by attaching a separate, elongated, rectangular auxiliary plate 22 (most clearly shown in FIG. 2) to the main plate 16 or 18. The lower edge of the plate-22 is parallel to the lower edge of the main plate 16 or 18, and the rear edge terminates in the plane of the rear edge of the main plate 16 or 18.

Figure 5:
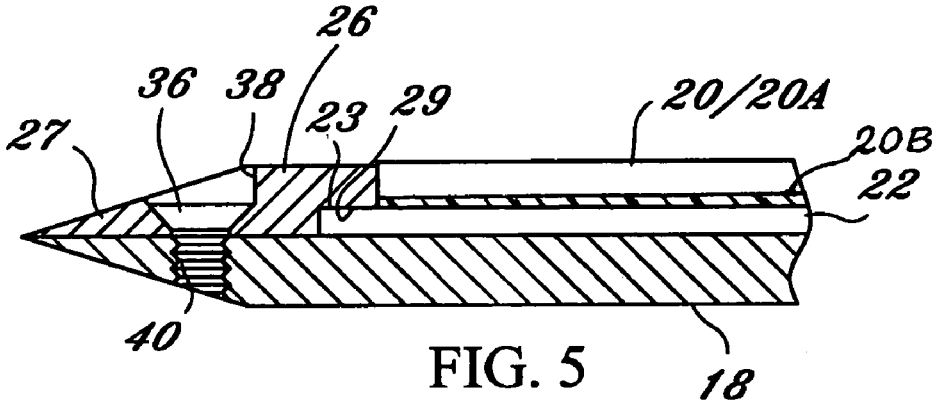
FIG. 5 is a partial cross-sectional view of the assembly of the portion of the embodiment shown in FIG. 4.
Figure 6:
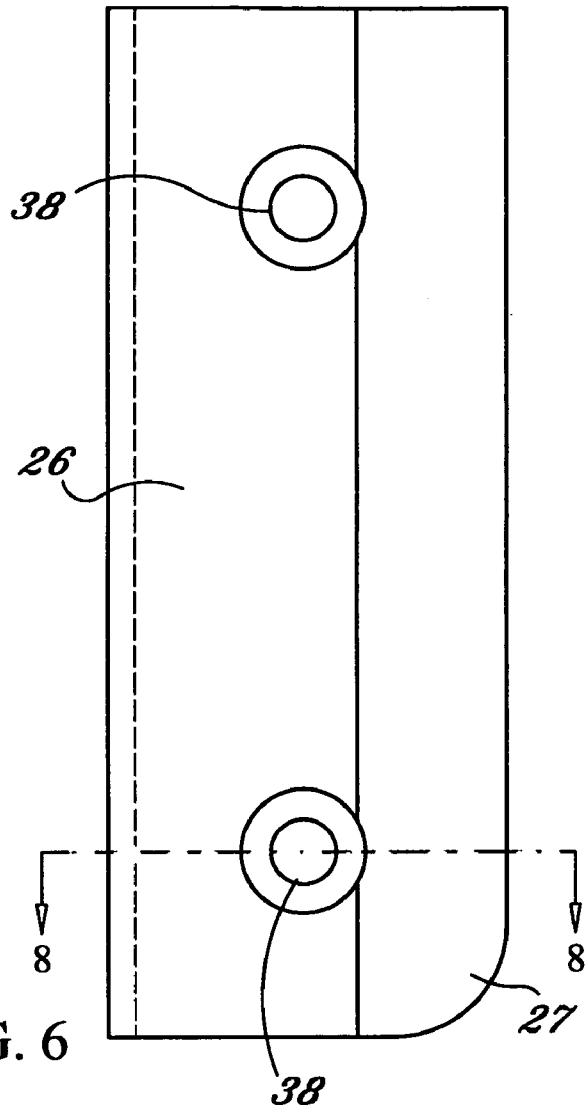
FIG. 6 is a top view of the portion of the embodiment shown in detail in FIGS. 4 and 5.
Figure 7:
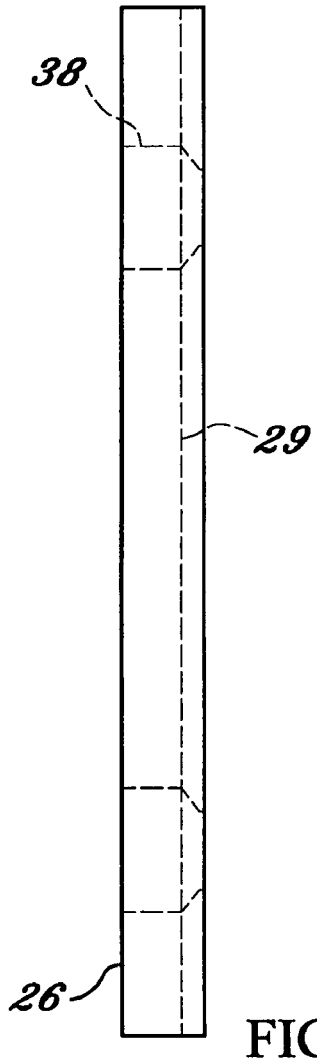
FIG. 7 is a front view of the portion shown in FIG. 6.

The front or forward edge of the auxiliary plate 22 terminates a slight distance toward the rear of the front edge of the main plate 16 or 18, as shown most clearly in FIG. 5. In the space between the front edge of the auxiliary plate 22 and the front edge of the main plate 16 or 18, a nose piece or shoe 26, having a beveled front edge (again as shown most clearly in FIGS. 4 and 5), is attached. As shown in FIG. 5, this attachment of the nose piece 26 is effected through recessed holes 38 by means of bolts 36, which engage tapped holes 40 (or recessed nuts secured into the exposed or outer surface of the plates 18 or 16) to firmly hold the nose piece or shoe 26 in place on the surface 23 of the plate 16 or 18 adjacent the front edge of the auxiliary plate 22. This assembly is shown most clearly in FIGS. 4 and 5, with FIG. 5 illustrating the details of the manner of this attachment.

Figure 8:
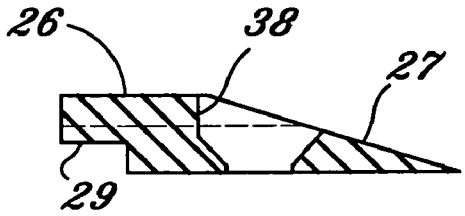
FIG. 8 is a cross-sectional view taken along the line 8—8 of FIG. 6.

It should be noted that the bolts 36 through the nose piece 26 do not extend through the exposed surface of the main plate 16 or 18; and the head of the bolts 36 are below the exposed surface of the nose piece 26 in the recesses 38, as shown most clearly in FIG. 5. It also should be noted that the nose piece 26 is tapered from the front edge outwardly to the upper surface, again as shown most clearly in FIGS. 4, 5 and 8. As shown in FIGS. 5 and 8, the manner in which the nose piece fits over the front edge of the auxiliary plate 22 is by means of a recess 29 having a thickness equal to the thickness of the plate 22.

The remainder of the surfaces of the main plate members 16 and 18 and the surface of the auxiliary plate 22, located to the rear of the nose piece 26, are coated with yieldable friction material 20, preferably (but not necessarily) in the form of rubber or rubber-like material having resilient compressible characteristics. In order to improve the resiliency and to prevent compression from hardening the yieldable material, the rubber or rubber-like material is provided with elongated parallel grooves 20B extending from the front to the back, or from the front edge to the rear edge, of the main plate member 16 or 18 and the corresponding auxiliary plate 22, as illustrated in detail in FIG. 4 and in enlarged detail in FIG. 3.

The grooves or channels 20B are located between upper surfaces 20A as shown most clearly in FIG. 8. Consequently, when pressure is applied through a squeezing action of the movement of the plates 16 and 18 toward one another to engage a load, the material 20A is compressed and is permitted to expand into the area of the grooves 20B in the relaxed or uncompressed condition shown in FIG. 3. This permits substantial resiliency; and once the load is released, the material is selected to rebound to the original configuration shown in FIG. 3. In place of elongated grooves 20B, circular depressions or cylindrical columns could also be used, as well as other configurations.

As illustrated in FIG. 5, the vertical thickness of the rubberized material 20A is selected to be slightly above the upper plane of the nose piece 26. Consequently, upon engagement of the clamping plates 16 and 18 with a load, the rubber or rubber-like material 20 which covers the auxiliary plate 22 is compressed along with compression of the material 20 which overlies or covers the remainder of the facing surfaces of the main plate members 16 and 18.

Typically, the main plate members 16 and 18 have a thickness on the order of ⅜" or greater; and the backing plate 22 has a thickness of approximately ¼" or greater, with a vertical height or width of approximately 8". This dimension is by way of example and it may vary to be more or less than 8". The material 20 then has a thickness of the portion 20A which is greater than ¼" and may extend to a thickness of 1¼". For example, a thickness of ⅝" over the exposed facing surfaces of either of the plates 16 or 18, and with a thickness of ⅜" or greater over the surface of the auxiliary plate 22 has been found suitable. The overall thickness of the rubber or rubber-like coating 20 is selected so that the plane of the upper surfaces of the portions 20A, which overlies the auxiliary plate 22 as well as the remainder of the surface of the main backing 16 and 18, is all in the same plane.

By providing the auxiliary plate 22 with a separate rubberized coating from the coating which covers the major portion of the remainder of the main plate members 16 and 18, any excessive wear which occurs, as mentioned above, typically on the lower edge of such plates, will occur on the rubberized portion overlying the auxiliary plate 22. If excessive wear should occur in this region, bolts 30 which extend through recessed holes 32 in the plate 22 (to removably secure the plate 22 to the main plate members 16 or 18), may be removed; and the plate 22, with the rubberized coating 20 on it, is removed and replaced with a new coated auxiliary plate 22. This auxiliary plate 22 is a relatively small portion of the mass of the overall assembly, and yet this is the region where wear most frequently has occurred in the past. Consequently, by replacing only this portion of the entire assembly, the composite assembly enjoys a significantly extended life. In addition, the utilization of the nose piece 26 reduces wear which, in the past, has occurred at the lower facing corners of clamping plates like the plates 16 and 18 of such assemblies. If the nose piece 26 should somehow itself become damaged, it is readily replaced by removing the bolts 36 shown in FIGS. 4 and 5, and then reassembling a new nose piece 26 with the bolts 36 in the manner described above.

The foregoing description of embodiments of the invention is to be considered as illustrative and not as limiting. Various changes and modifications will occur to those skilled in the art for performing substantially the same function, in substantially the same way, to achieve substantially the same results without departing from the true scope of the invention as defined in the appended claims.

What is claimed is:

1. A clamping plate assembly for movement laterally into and out of engagement with a load including in combination: a main plate member having front, rear, upper and lower edges; an auxiliary plate overlying the main plate member and extending from the lower edge of the main plate member a predetermined distance toward the upper edge thereof and extending substantially from the rear edge of the main plate member to the front edge thereof, where the predetermined distance is a fraction of the distance between the lower and upper edges of the main plate member, with the auxiliary plate removably attached to the main plate member; and yieldable friction material over substantially the major portions of the auxiliary plate and the portion of the main plate member not covered by the auxiliary plate; wherein the thickness of the yieldable friction material on the portion of the main plate member is greater than the thickness of the auxiliary plate; and the thickness of the yieldable friction material on the auxiliary plate is selected to cause the exposed surface of the yieldable friction material on the auxiliary plate to be in the same plane as the exposed surface of the yieldable friction material on the main plate assembly.

2. A clamping plate assembly according to claim 1 wherein the yieldable friction material is selected to be made of resilient compressible material.

3. A clamping plate according to claim 2 wherein the yieldable friction material is a compressible rubber-like material.

4. A clamping plate assembly according to claim 3 wherein the yieldable friction material is bonded to the auxiliary plate and the portion of the main plate member not covered by the auxiliary plate.

5. A clamping plate assembly according to claim 4 wherein the yieldable friction material is a rubber-like material having a plurality of closed spaced grooves in it extending parallel to one another between the front and lower edges of the main plate member and substantially parallel to the upper and lower edges of the main plate member.

6. A clamping plate assembly according to claim 5 wherein the thickness of the yieldable friction material is between ⅝", and 1¼" in the portions between the grooves therein.

7. A clamping plate assembly according to claim 6 wherein the main plate member and the auxiliary plate are made of aluminum.

8. A clamping plate assembly according to claim 7 further including recessed bolts for removably attaching the auxiliary plate to the main plate member.

9. A clamping plate assembly according to claim 8 wherein the auxiliary plate has a front edge and a rear edge, with the rear edge thereof substantially terminating in the same plane as the rear edge of the main plate member and the front edge of the auxiliary plate terminating a short distance from the front edge of the main plate member, and further including a wear resistant nose piece attached to the main plate member between the front edge thereof and the front edge of the auxiliary plate.

10. A clamping plate assembly according to claim 9 wherein the nose piece is made of wear resistant material.

11. The clamping plate assembly according to claim 9 wherein the nose piece is made of aluminum with the front edge thereof tapering from the front edge of the main plate member outwardly from the main plate member to a surface located in a plane parallel to the main plate member.

12. A clamping plate assembly according to claim 11 wherein the thickness of the combination of the auxiliary plate and the yieldable friction material thereon is greater than the maximum thickness of the nose piece.

13. A clamping plate assembly according to claim 12 wherein the auxiliary plate and the nose piece are removably attached to the main plate member with countersunk bolts, the exposed heads thereof being below the exposed surfaces of the auxiliary plate and the nose piece.

14. A clamping plate assembly according to claim 1 wherein the auxiliary plate has a front edge and a rear edge, with the rear edge thereof substantially terminating in the same plane as the rear edge of the main plate member and the front edge of the auxiliary plate terminating a short distance from the front edge of the main plate member, and further including a wear resistant nose piece attached to the main plate member between the front edge thereof and the front edge of the auxiliary plate.

15. A clamping plate assembly according to claim 14 wherein the nose piece is made of wear resistant material.

16. The clamping plate assembly according to claim 15 wherein the nose piece is made of aluminum with the front edge thereof tapering from the front edge of the main plate member outwardly from the main plate member to a surface located in a plane parallel to the main plate member.

17. A clamping plate assembly according to claim 16 wherein the thickness of the combination of the auxiliary plate and the yieldable friction material thereon is greater than the maximum thickness of the nose piece.

18. A clamping plate assembly according to claim 17 wherein the auxiliary plate and the nose piece are removably attached to the main plate member with countersunk bolts, the exposed heads thereof being below the exposed surfaces of the auxiliary plate and the nose piece.

19. A clamping plate assembly according to claim 18 wherein the yieldable friction material is a rubber-like material having a plurality of closed spaced grooves in it extending parallel to one another between the front and lower edges of the main plate member and substantially parallel to the upper and lower edges of the main plate member.

20. A clamping plate assembly according to claim 19 wherein the thickness of the yieldable friction material is between ⅝" and 1¼" in the portions between the grooves therein.

21. A clamping plate assembly according to claim 1 wherein the main plate member and the auxiliary plate are made of aluminum.

22. A clamping plate assembly according to claim 1 wherein the yieldable friction material is bonded to the auxiliary plate and the portion of the main plate member not covered by the auxiliary plate.

23. A clamping plate assembly according to claim 1 further including recessed bolts for removably attaching the auxiliary plate to the main plate member.

24. A clamping plate assembly for movement laterally into and out of engagement with a load including in combination:

a main rectangular plate member having front, rear, upper and lower edges; an auxiliary plate overlying the main plate member and extending from the lower edge of the main plate member a short distance toward the upper edge thereof and extending substantially from the rear edge of the main plate member to the front edge thereof, the short distance being a minor portion of the distance between the lower and upper edges of the main backing plate member and with the auxiliary plate removably attached to the main plate member; yieldable friction material attached to and covering substantially the major portion of the auxiliary plate and the portion of the main plate member not covered by the auxiliary plate; and a wear resistant nose piece attached to the main plate member between the front edge thereof and the front edge of the auxiliary plate wherein the auxiliary plate and the nose piece are removably attached to the main plate member with countersunk bolts, the exposed heads thereof being below the exposed surfaces of the auxiliary plate and the nose piece.

25. A clamping plate assembly according to claim 24 wherein the yieldable friction material is selected to be made of resilient compressible material.

26. A clamping plate assembly according to claim 25 wherein the yieldable friction material is a rubber-like material having a plurality of closed spaced grooves in it extending parallel to one another between the front and lower edges of the main plate member and substantially parallel to the upper and lower edges of the main plate member.

27. A clamping plate assembly according to claim 26 wherein the thickness of the yieldable friction material is between ⅜", and 1¼" in the portions between the grooves therein.

28. A clamping plate assembly according to claim 27 wherein the nose piece is made of wear resistant material.

29. A clamping plate assembly according to claim 24 wherein the yieldable friction material is bonded to the auxiliary plate and the portion of the main plate member not covered by the auxiliary plate.

* * * * *